US007182305B2

(12) United States Patent
Dempsey

(10) Patent No.: US 7,182,305 B2
(45) Date of Patent: Feb. 27, 2007

(54) PRODUCT DISPLAY

(75) Inventor: Martha A. Dempsey, Cleveland, OH (US)

(73) Assignee: Dempsey Printing, Inc., Oakwood, OH (US)

( * ) Notice: Subject to any disclaimer, the term of this patent is extended or adjusted under 35 U.S.C. 154(b) by 0 days.

(21) Appl. No.: 10/696,128

(22) Filed: Oct. 29, 2003

(65) Prior Publication Data

US 2004/0245413 A1 Dec. 9, 2004

Related U.S. Application Data

(60) Provisional application No. 60/477,222, filed on Jun. 9, 2003.

(51) Int. Cl.
*A47G 23/02* (2006.01)

(52) U.S. Cl. ..... 248/459; 248/150; 248/300; 248/454; 248/455; 206/45.24; 40/124.09; 40/124.15; 40/124.16

(58) Field of Classification Search ..... 248/454, 248/455, 456, 457, 463, 465, 150, 146, 152, 248/300, 909, 459; 206/45.24, 45.21, 45.25, 206/45.27, 45.29, 45.3; 40/124.15, 124.16, 40/124.18, 124.19, 539, 129.09
See application file for complete search history.

(56) References Cited

U.S. PATENT DOCUMENTS

| | | | | | |
|---|---|---|---|---|---|
| 415,552 | A | * | 11/1889 | Orr | 40/750 |
| 1,053,112 | A | * | 2/1913 | Scott | 248/456 |
| 1,543,102 | A | | 6/1925 | Fleischer | |
| 1,699,875 | A | | 1/1929 | Burgess | |
| 1,713,758 | A | | 5/1929 | Horwath | |
| 1,718,319 | A | | 6/1929 | Towell | |
| 1,896,677 | A | | 2/1933 | Myers | |
| 2,003,244 | A | | 5/1935 | Carboni | |
| 2,097,553 | A | | 11/1937 | Gruenberg | |
| 2,105,594 | A | | 1/1938 | Henrich | |
| 2,110,429 | A | | 3/1938 | Sunderhauf | |
| 2,168,063 | A | | 8/1939 | Everson | |
| 2,252,571 | A | * | 8/1941 | Kohn | 248/459 |
| 2,726,835 | A | | 12/1955 | Hummel | |
| 3,002,608 | A | * | 10/1961 | Zwickey | 206/763 |
| 3,013,668 | A | | 12/1961 | Mennen | |
| 4,291,807 | A | * | 9/1981 | Giordano et al. | 229/212 |
| 4,383,782 | A | * | 5/1983 | Pillifant, Jr. | 404/6 |
| 4,460,146 | A | * | 7/1984 | Raggiotti | 248/456 |
| D278,109 | S | | 3/1985 | Leeds | |
| 4,917,240 | A | * | 4/1990 | Roberts et al. | 206/232 |
| 5,234,190 | A | * | 8/1993 | Cross | 248/459 |
| 5,297,677 | A | * | 3/1994 | Burian et al. | 206/362.4 |
| 5,301,800 | A | | 4/1994 | Kenney | |
| 5,423,425 | A | | 6/1995 | Stompe | |

(Continued)

*Primary Examiner*—Amy J. Sterling
(74) *Attorney, Agent, or Firm*—McDonald Hopkins Co., LPA; Robert H. Earp, III; David B. Cupar

(57) ABSTRACT

The present invention is directed to a product display. The product display can hold printed materials, literature, and other goods. The product display is a one-piece construction that is flat when it is in an unassembled position. In the assembled position, the product display includes a front panel section, a bottom section connected to the front panel section, and a back section connected to the bottom section. The front panel section connects to the back section either directly or by way of a brace section on the front panel. The product display includes an opening in the panel that holds products in an upright manner. Preferably, one of the bottom panel, back panel or brace section includes a flap. The present product display does not require an added on or formed pocket that extends outwardly from the panel.

10 Claims, 6 Drawing Sheets

U.S. PATENT DOCUMENTS 5,458,242 A 10/1995 Baka et al.
5,630,546 A 5/1997 Velch
5,727,696 A 3/1998 Valiulis
5,848,698 A 12/1998 Stompe
D410,686 S 6/1999 Wear
6,568,543 B1 * 5/2003 Schneider ..... 211/43
6,648,293 B1 * 11/2003 Sachnoff ..... 248/460

* cited by examiner

PRODUCT DISPLAY

This application claims priority from U.S. Provisional Application Ser. No. 60/477,222, filed on Jun. 9, 2003.

FIELD OF THE INVENTION

This invention pertains to a product display having an integrated space that allows for the insertion and removal of products. More specifically, the invention relates to a display that, in its unassembled state, is a flat, single-piece design and, when assembled, is in an upright fashion for display and insertion or removal of products and materials.

BACKGROUND OF THE INVENTION

Product displays, such as literature displays for providing printed materials to consumers, are rather common. Generally, there are several common types of displays. The most common display is one where a user attaches a pocket to a front portion of a display panel and attaches a separate easel-type of stand on the back portion of the panel to support the display in an upright position. The pocket and stand can be attached by either gluing or stapling tabs to attach the pocket to the front and the stand to the back.

This type of display is costly to manufacture because it generally requires multiple components, including a panel, pocket and stand. In particular, each component must then be processed individually thereby increasing the manufacturing costs. Also, such displays require a relatively large amount of material due to the multiple component design, which also increase costs.

Known product displays are also difficult to initially set-up. Specifically, a user must typically fold the pocket, panel and stand from an initial flat position into a usable three-dimensional position. The user must then connect the pocket and stand to the panel properly to form the display. The number of steps and the relative difficulty in connecting the pocket and stand to the panel can cause the set-up difficulties. Once set-up, known product displays can easily fall apart or break in a relatively short period of time. The pocket, panel, or stand can break off due to a failure in the glue, staples, or tabs holding the components together. Also, the components may not re-attach properly or not look aesthetically pleasing once re-attached.

Displays and holders for goods made from a single sheet of cardboard are known. Many of these are collapsible. Nevertheless, these known displays are not stable in their assembled position. Also, these types of displays are difficult to manufacture and assemble due to their relatively intricate design. Another problem with these known displays are that they do not provide a suitable force to the goods inserted and held in the display. For example, U.S. Pat. No. 5,458,242 provides a single piece cardboard display. The display includes a flap that is pushed inwardly during assembly to provide an opening for literature. The flap, however, fails to provide an adequate force on the literature inserted into the display so that the literature can be easily moved therein by any force cause by accidental pushing or movement of the display during its normal use.

It would therefore be desirable to have a product display having reduced manufacturing costs while providing an easier to set-up, more stable and more effective display for distributing products.

SUMMARY OF THE INVENTION

The present invention is directed to a product display. The product display is a one-piece construction that is flat when it is in an unassembled position. In the assembled position, the product display includes a front panel section, a bottom section connected to the front panel section, and a back section connected to the bottom section. The front panel section includes a brace section that attaches to the back section. The product display includes an opening in the panel that holds products in an upright manner. Preferably, the brace section includes a flap. The present product display does not require an added on or formed pocket that extends outwardly from the panel.

The product display also includes a flap. The brace section, back portion, or the bottom section can include the support tab. The support tab provides a spring biasing force on the product or products placed in the opening on the front panel section to support the product in an upright position. The spring biasing force of the support tab also allows the product display to act as a self-adjusting dispenser for the product.

In another aspect, the present invention is directed to a holder for goods. The holder includes a bottom panel, a front panel connected to the bottom panel, and a back panel connected to the bottom panel. The front panel includes an opening. The back panel includes a flap that extends downwardly from the back panel to the front panel. Preferably, the flap extends downwardly from the back panel to the front panel such that the flap is capable of contacting the front panel below the opening.

In a further aspect, the present invention is directed to a holder for goods. The holder includes a bottom panel, a front panel connected to the bottom panel and a back panel connected to the bottom panel. The front panel includes an opening. The bottom panel includes a flap that extends upwardly from the bottom panel to the front panel. Preferably, the flap extends upwardly from the bottom panel to the front panel such that the flap is capable of contacting the front panel below the opening.

In a further aspect, the present invention is directed to a holder for goods including a bottom panel, a front panel connected to the bottom panel, and a back panel connected to the bottom panel. The front panel includes an opening and a brace section extending from the front panel along an edge of the opening toward the back panel. The brace includes a flap extending from the brace toward the front panel. Preferably, the flap extends downwardly from the brace toward the front panel and is capable of contacting the front panel below the opening.

In yet a further aspect, the present invention is directed to a holder for goods. The holder includes an elongated sheet having a first, second, third and fourth score lines. The first score line can be bent to form a front panel and a bottom panel. The second score line can be bent to form a back panel from the bottom panel. The third score line is on the front panel and can be bent to form a brace section. The fourth score line is on the brace section and can be bent to form a flap. Preferably, the brace section and the back panel are connected by a connecting means.

Still other benefits and advantages of the invention will become apparent to those skilled in the art upon a reading and understanding of the following detailed description.

BRIEF DESCRIPTION OF THE DRAWINGS

The invention may take physical form in certain parts and arrangement of parts in a preferred embodiment of which will be described in detail in this specification and illustrated in the accompanying drawings which form a part hereof and wherein.

DETAILED DESCRIPTION OF THE PREFERRED EMBODIMENTS

Figure 1:
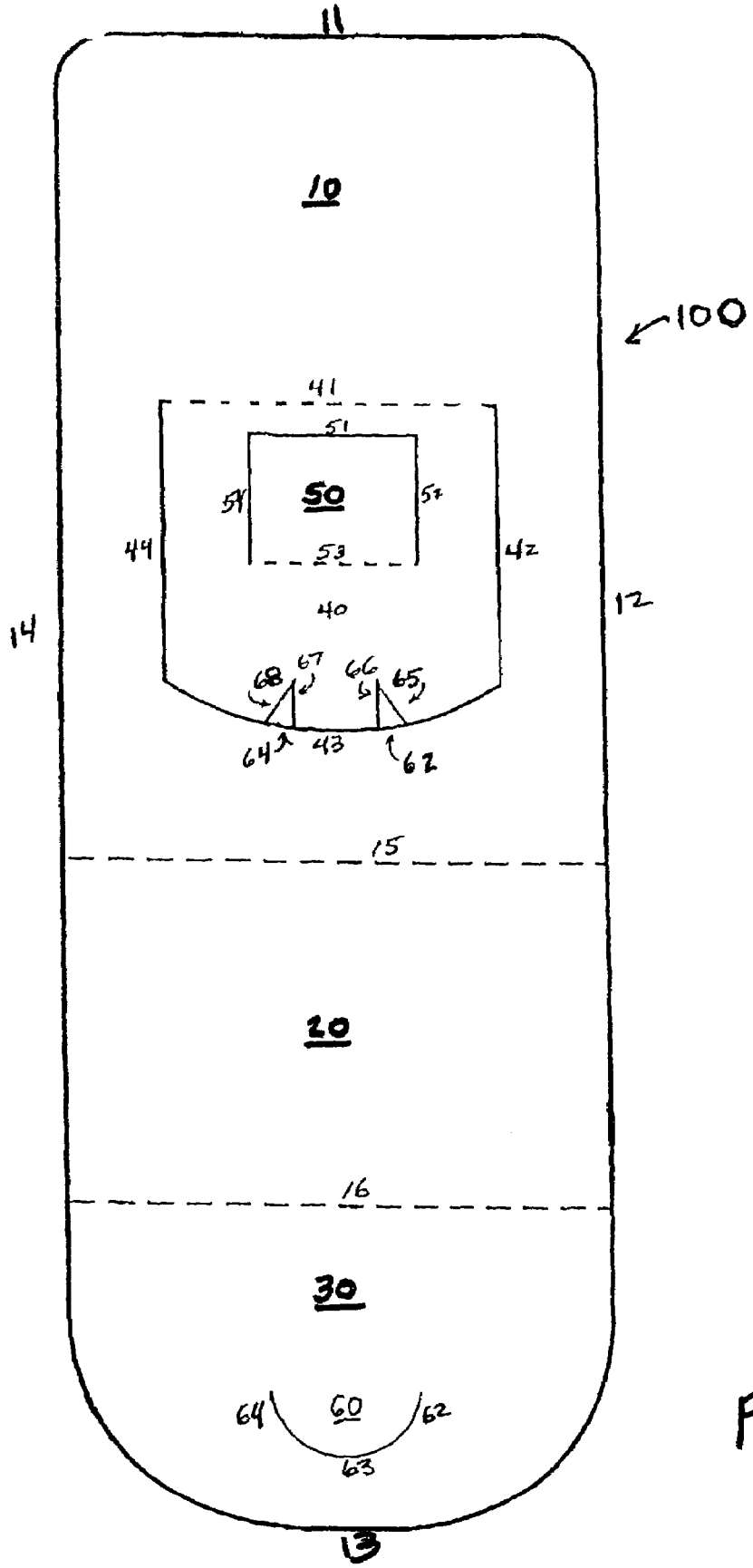
FIG. 1 is a plan view of a product display in a flat, unassembled position.

Referring now to the drawings wherein the drawings are for purposes of illustrating the preferred embodiments only and not for the purposes of limiting the same:

FIG. 1 shows a product display 100 in a flat unassembled position. The display 100 is defined in its flat unassembled position as a single sheet by a top edge 11, bottom edge 13, right side 12 and left side 14. The display 100 further includes first score line 15 and second score line 16. The display 100 can be folded at a first score line 15 to form a front panel section 10 and bottom section 20. The display 100 can be folded at a second score line 16 to form the back section 30.

FIG. 1 further illustrates that within the front panel section 10, a brace section 40 is defined by top score line 41, bottom edge 43, right side 42 and left side 44. The brace section 40 includes locking notches 62 and 64 that forms a tab therefrom. Locking notch 62 includes edges 65, 66. Locking notch 64 includes edges 67, 68. The brace section 40 includes a flap 50 that is defined by a top edge 51, bottom score line 53, right side 52 and left side 54. Although FIG. 1 shows the brace section 40 including the flap 50, it is contemplated that the bottom portion 20 can include the support tab.

FIG. 1 also illustrates a locking tab 60 on the back section 30. The locking tab 60 is preferably of a semi-circular shape defined by a right edge 62, bottom edge 63, and left edge 64. Of course, it is contemplated that the locking tab 60 may be other geometric and non-geometric shapes. The locking tab 60 provides a slit or opening between the locking tab 60 and the back panel 30. It is of course contemplated that any other known connecting means can be used to connect the brace section 60 with the back panel section 30. As used herein, "connecting means" can include tabs, adhesive, staple, and stitching.

Figure 2:
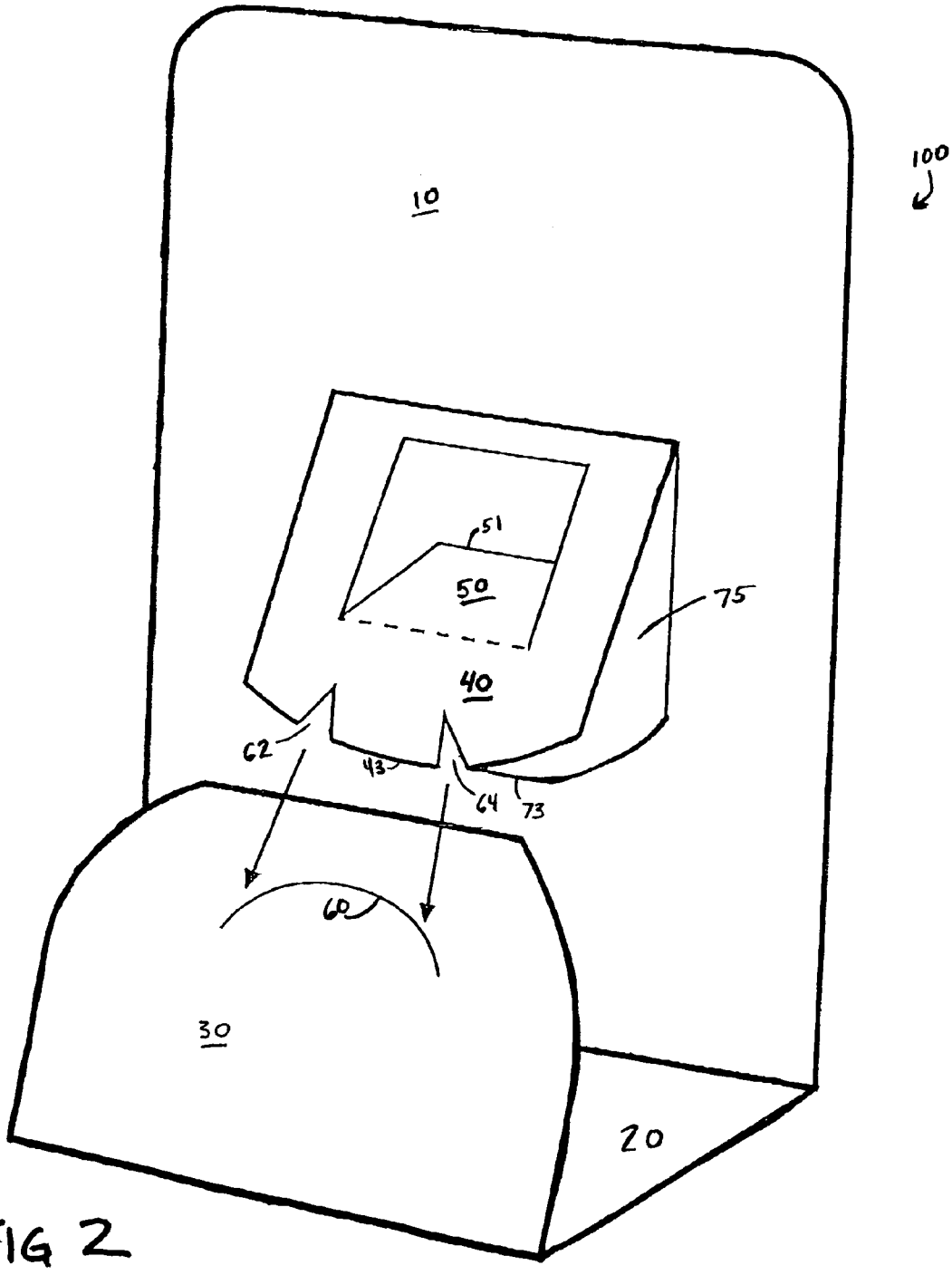
FIG. 2 is a partially folded, rear plan view of the display.
Figure 3:
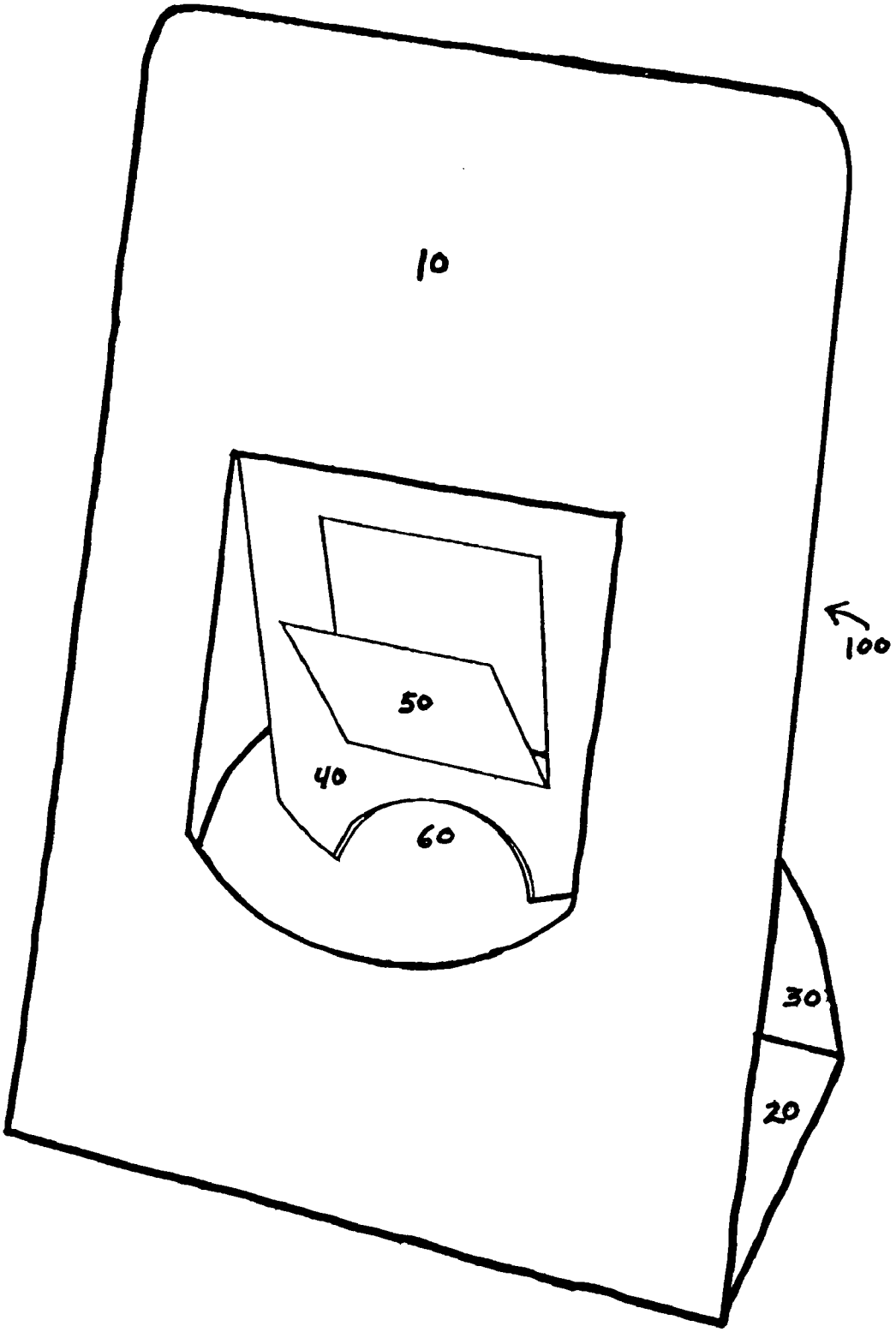
FIG. 3 is a perspective view of the partially assembled product display.
Figure 4:
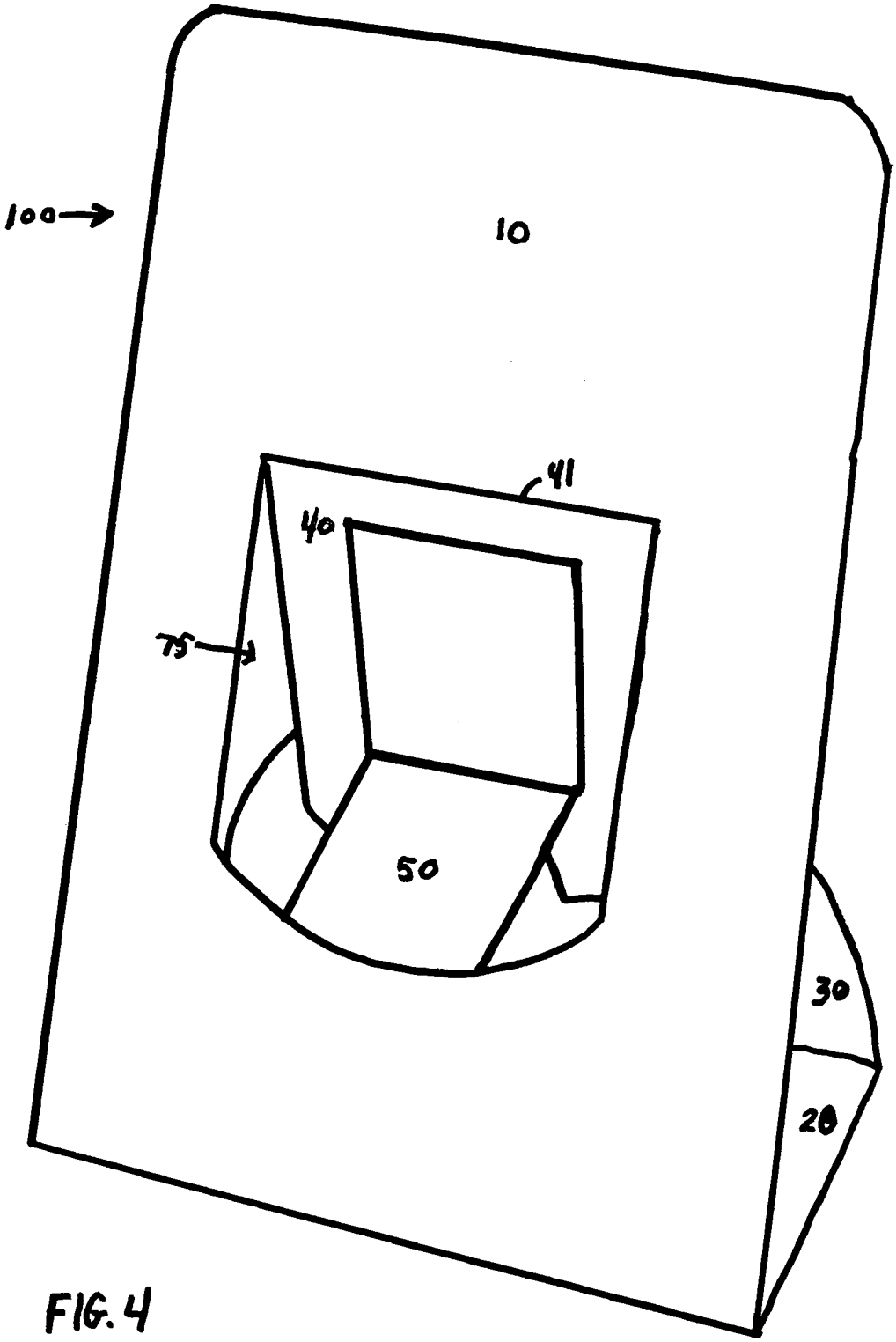
FIG. 4 is a perspective view of the product display in a fully assembled position.

FIG. 2 illustrates the connection of the brace section. 40 to the back section 30 during assembly. The front panel section 10 and back panel section 30 are bent toward each other at scores 15, 16 so that the front panel section 10 and back panel section 30 each form an acute angle with the bottom portion 20. The brace portion 40 is then bent at top score line 41 toward the back portion 30. An opening 75 on the front panel section 10 is formed. When the brace section 40 is bent at the top score line 41 to connect the brace section 40 to the back section 30, the tab on the bottom edge 43 of the brace portion 40 between the locking notches 62, 64 is inserted into the slit formed by the locking tab 60. The locking notches 62, 64 allow the bottom edge 43 of the brace section 40 to insert into the slit formed by the locking tab 60 on either side of the back section 30 for successful assembly as shown in FIG. 3. The flap 50 can then be pushed toward a bottom edge 73 of an opening 75. The flap 50 is pushed past the bottom edge 73 and the top edge 51 of the flap 50 abuts the inner portion of the front panel section 10 below the bottom edge 73. Of course, the top edge 51 abuts the product when the product is inserted into the opening 75. FIG. 4 shows the final assembled product display 100.

Figure 5:
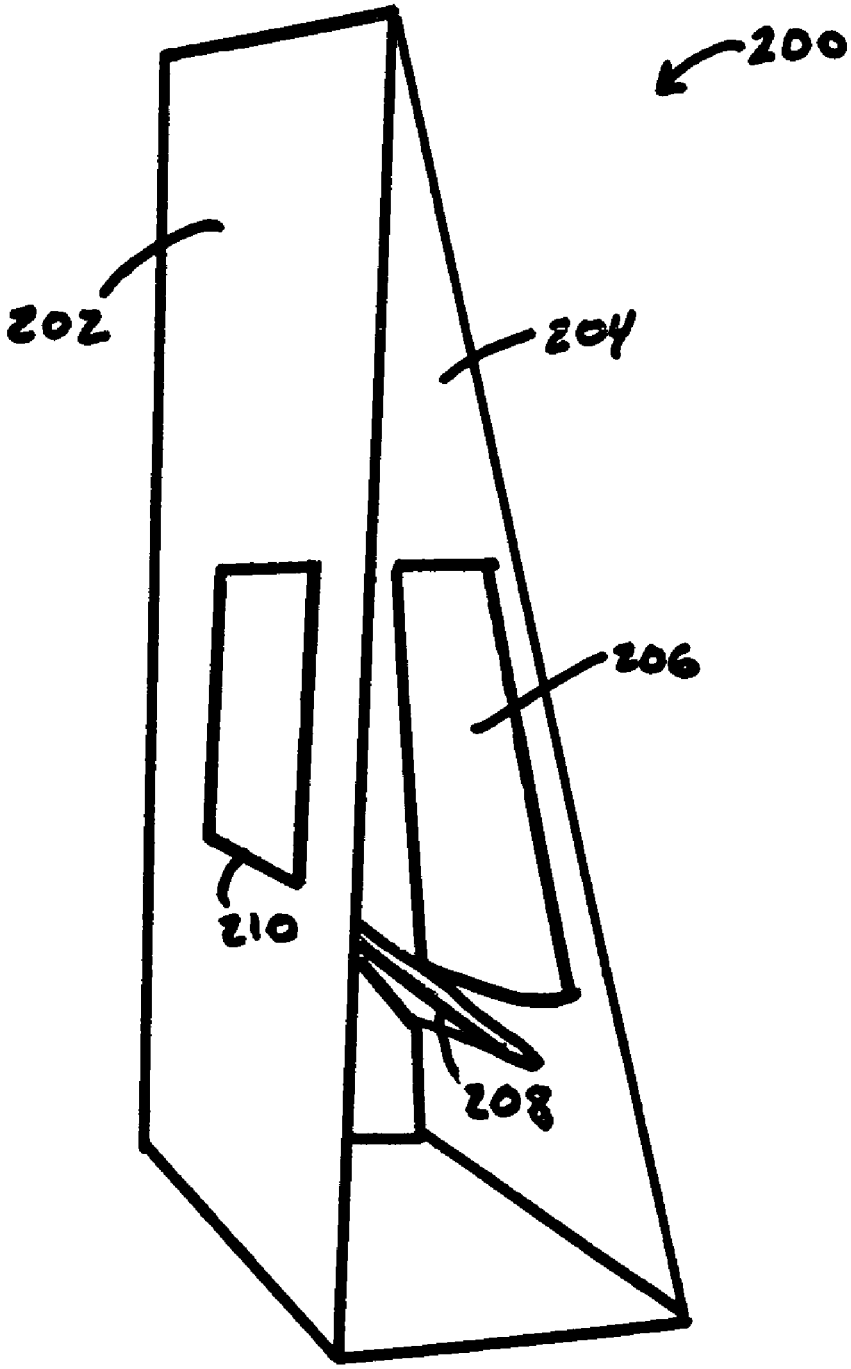
FIG. 5 is a side perspective view of the produce display where the flap is connected to the back portion.

It is contemplated in the present invention that the flap does not necessarily extend from a brace section. It is also contemplated that the display does not necessarily include a brace section. One alternate embodiment for the location of the flap is shown in FIG. 5. FIG. 5 shows a display 200 having the back portion 202 extending upward toward and connecting to the front panel 204. The front panel 204 would include an opening 206. The rear panel 202 includes a flap 208 connected along edge 210 to the rear panel 202. The flap 208 extends from the rear panel 202 toward the front panel 204. Preferably, the flap 208 extends downwardly from the rear panel 202 to the front panel 204 and is capable of contacting the front panel 204 below the opening 206.

Figure 6:
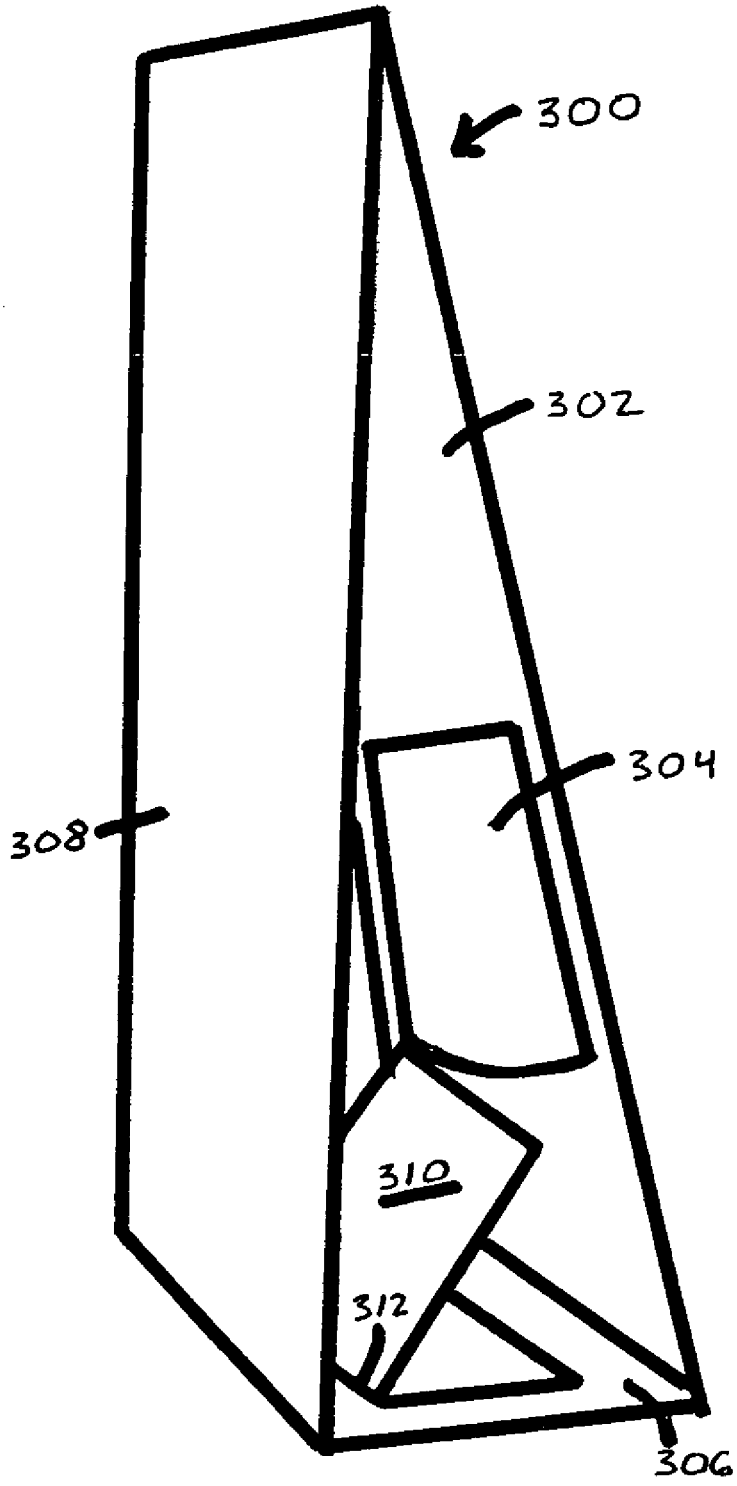
FIG. 6 is a side perspective view of the product display where the flap is connected to the bottom portion.

It is also contemplated that the flap can extend from the bottom panel 306 as is shown in FIG. 6. FIG. 6 shows an alternate display 300 that includes a front panel 302. The front panel 302 includes an opening 304. The front panel 302 is connected to the bottom panel 306. The bottom panel 306 is connected to a back panel 308. The back panel 308 and front panel 302 can be connected directly to one another by a connecting means. Alternatively, the front panel 302 or back panel 308 can further include a brace (not shown) that connects the front panel 302 and back panel 308. The bottom panel 306 is connected to a flap 310 along edge 312. The flap 310 extends upwardly from the bottom panel 306 toward the front panel 302. Preferably, the flap 310 is capable of contacting the front panel 302 below the opening 304.

Any one or more of the front panel, bottom panel, back panel, brace, and/or flap can be adjusted according to any size, shape, and/or angle according to the size of the goods inserted in the display or according to the aesthetic features desired. Thus, the present display is not limited in any way by any size, shape, and/or angle of any of its features.

Another feature the present display is capable of is the ability to incorporate artwork on the front panel of the display with artwork of the goods in the display seamlessly. This feature further provides the present display with a desirable aesthetic appearance.

A further feature that is possible with the present display is the inclusion of other advertising features. For example, additional displays and/or holders can be connected by any connecting means to the present display. These additional displays and/or holders provide an additional aesthetic appearance and further act as a holder for additional goods to the present display.

It is also contemplated in the present invention that the display can be formed from any known material. Such materials include corrugated material, paperboard, cardboard, plastic, styrene, solid bleached sulfate (SBS), foam core, and the like. Preferably, the present display is formed from any known corrugated, paperboard, or cardboard material by die-cutting or the like. Nevertheless, it should be appreciated that other materials are suitable if those materials are considered necessary or advantageous.

In use, products (not shown), such as printed materials, literature, compact discs, advertising materials, and any other possible form of goods are inserted into the opening 75 so that the products abut the inner portion of the front panel section 10 and the top edge 51 of the flap 50. The flap 50 provides a spring biasing force on the products to provide it support. Due to the acute angle of the front panel section 10 relative to the bottom section 20, the portion of the products above the top scored edge 41 is supported by the front panel section 10. Once a product is removed from the product display 100, the flap 50 continues to provide the spring biasing force on the remaining products.

Thus, any of the variables disclosed herein can readily be determined and controlled without departing from the scope of the invention herein disclosed and described. Moreover, the scope of the invention shall include all modifications and variations that fall within the scope of the attached claims.

Having therefore described the invention, it is claimed:

1. A holder for goods comprising:

a front panel having a front portion and a back portion and an opening therethrough;

a bottom panel connected to said front panel;

a back panel connected to said bottom panel;

said front panel including a brace section connected to said back panel; and said brace section including a flap, said flap being bent downwardly from said brace section and toward said back portion of said front panel to provide a spring biasing force on said back portion of said front panel so as to hold the goods in said opening.

2. The holder of claim 1, wherein said brace section is connected to said front panel along an edge of said opening.

3. The holder of claim 1, wherein said flap is capable of contacting said front panel below said opening.

4. The holder of claim 1, wherein one of said brace section and back panel includes at least one notch and the other of said back panel and brace section includes a support tab.

5. The holder of claim 4, wherein said support tab and notch are releasably engageable to connect said brace section to said back panel.

6. A holder for goods comprising:

an elongated sheet having first, second, third and fourth transverse score lines, said first score line being bent to form a front panel having a front portion and a back portion and a bottom panel, said second score line being bent to form a back panel, said third score line on said front panel being bent to form a brace section, said fourth score line on said brace section being bent to form a flap that extends downwardly from said brace section and towards said back portion of said front panel, wherein said flap provides a spring biasing force on said back portion of said front panel so as to hold the goods in the holder;

a connecting means for connecting said brace section to said rear panel.

7. The holder of claim 6, wherein said flap is capable of contacting said front panel.

8. The holder of claim 6, wherein said brace section being bent on said third score line of said front panel defines an opening on said front panel.

9. The holder of claim 8, wherein said flap is capable of contacting said front panel below said opening.

10. The holder of claim 6, wherein said connecting means includes a support tab on one of said brace section and rear panel and at least one notch on the other of said brace section and said rear panel for connecting said brace section to said rear panel.

* * * * *